United States Patent [19]

Nazar

[11] Patent Number: 4,652,048

[45] **Date of Patent: * Mar. 24, 1987**

[54] PORTABLE ADJUSTABLE CHAIR WITH INSULATED SEAT COOLER

[76] Inventor: Robert C. Nazar, 3730 Longview Dr., Carlsbad, Calif. 92008

[ * ] Notice: The portion of the term of this patent subsequent to Oct. 2, 2001 has been disclaimed.

[21] Appl. No.: 783,346

[22] Filed: Oct. 2, 1985

[51] Int. Cl.[4] ..... A47C 7/62

[52] U.S. Cl. ..... 297/192; 297/188

[58] Field of Search ..... 297/192, 377, 378, 193, 297/188, 372, 377, 378, 27

[56] References Cited

U.S. PATENT DOCUMENTS

| | | | |
|---|---|---|---|
| 845,039 | 2/1907 | Leavitt | 297/377 X |
| 1,952,216 | 3/1934 | Owings | 297/192 X |
| 2,357,214 | 8/1944 | McDole | 297/192 X |
| 2,372,077 | 3/1945 | Glinecki | 297/192 X |
| 2,982,455 | 5/1961 | Rosen | 297/192 X |
| 3,290,089 | 12/1966 | Farrell | 297/192 X |
| 4,061,395 | 12/1977 | Boole | 312/205 X |
| 4,474,407 | 10/1984 | Nazar | 297/192 |
| 4,482,184 | 11/1984 | Mincey | 297/378 X |
| 4,527,830 | 7/1985 | Meyers | 297/17 X |
| 4,556,250 | 12/1985 | Chapman et al. | 297/192 |

*Primary Examiner*—Kenneth J. Dorner
*Assistant Examiner*—José V. Chen
*Attorney, Agent, or Firm*—Baker, Maxham & Jester

[57] ABSTRACT

A box like insulated container forms a seat support platform for a portable folding chair or seat with a backrest that is pivotally secured to the back of the housing for extending upward in a support position and foldable onto the seat support platform and a stabilizer prop pivotally connected at the ends to the backrest and connected to the back of the housing for supporting the backrest in a support position.

14 Claims, 5 Drawing Figures

PORTABLE ADJUSTABLE CHAIR WITH INSULATED SEAT COOLER

BACKGROUND OF THE INVENTION

1. Field of the Invention

This invention relates to portable chairs of the picnic or beach variety which may be provided with an accessed, thermally insulated seat compartment for both carrying and insulating perishable foodstuffs, canned or bottled beverages, ice, or the like.

2. Prior Art

Known folding chairs constructed of tubular aluminum with nylon or canvas covering material or the like are well known. These portable chairs have the virtue of being very light to carry and provide an inexpensive means for comfortable reclining. Many conventional chairs require the occupant to sit near the ground and are sometimes provided with short legs.

To spend the day at the beach, conventional practice involves using and carrying a comfortable chair, a portable cooler for beverages and lunches, and a container to hold towels and other small articles. This conventional practice is relatively expensive and cumbersome to carry. Known folding chairs have the disadvantage of not possessing any storage facilities which can both hold small articles and thermally insulate perishable foodstuffs and bottled beverages.

A number of alternative means have been proposed to overcome some of the difficulties with conventional chairs. For example, several chairs have been devised with storage capability for beach or camping. Siday U.S. Pat. No. 1,900,847 discloses a chair with a receptacle in the seat. Taipalus, U.S. Pat. No. 4,210,363 discloses a seat with insulation in a receptacle area. Similarly, McDole, U.S. Pat. No. 2,357,214 discloses a fishing tackle box and receptacle with seat platform.

A variety of tackle box chairs and beach chairs exist and while each serves a specific purpose, the alternative means provided require insulating and carrying means, and are sometimes difficult to access without standing. Many of the alternatives available suffer from tipping or require the occupant to sit very low to the ground, and some are quite cumbersome to carry. Still others are provided with a back prop of such a design as to cause the occupant serious injury if suddenly collapsed.

SUMMARY OF THE INVENTION

It is an object of this present invention to provide an adjustable foldable chair of the type mentioned which overcomes at least some of the aforementioned disadvantages and concurrently therewith provides a thermally insulated storage facility for securing and storing canned or bottled beverages, ice, perishible foodstuffs, fishing bait, or other small articles.

It will be seen that the present invention overcomes some of these inadequacies by providing an easily grasped closure panel or lid to a seat platform with a thermally insulated compartment supported a comfortable distance from the ground by leg members, or bosses.

A further object is to provide a comfortable chair having easy access to the above mentioned compartment, cushioning and contoured seat portion, armrest support, and a padded shoulder strap for comfortable carrying. This comfort is further enhanced with an object being to provide varied reclining positions.

Another object is to provide a new and improved device which folds compactly and securely for storage and transport.

A further object is to provide a new and improved device which is lightweight, durable, easily maintained, and low in cost.

These together with other objects and advantages which will become apparent reside in the details of construction and operation as will be more fully described and claimed, references being made to the accompanying drawings forming a part hereof, wherein like numerals refer to like parts throughout and in which:

BRIEF DESCRIPTION OF THE DRAWINGS

The invention will hereafter be elucidated with reference to the drawings.

DETAILED DESCRIPTION OF THE INVENTION

Figure 1:
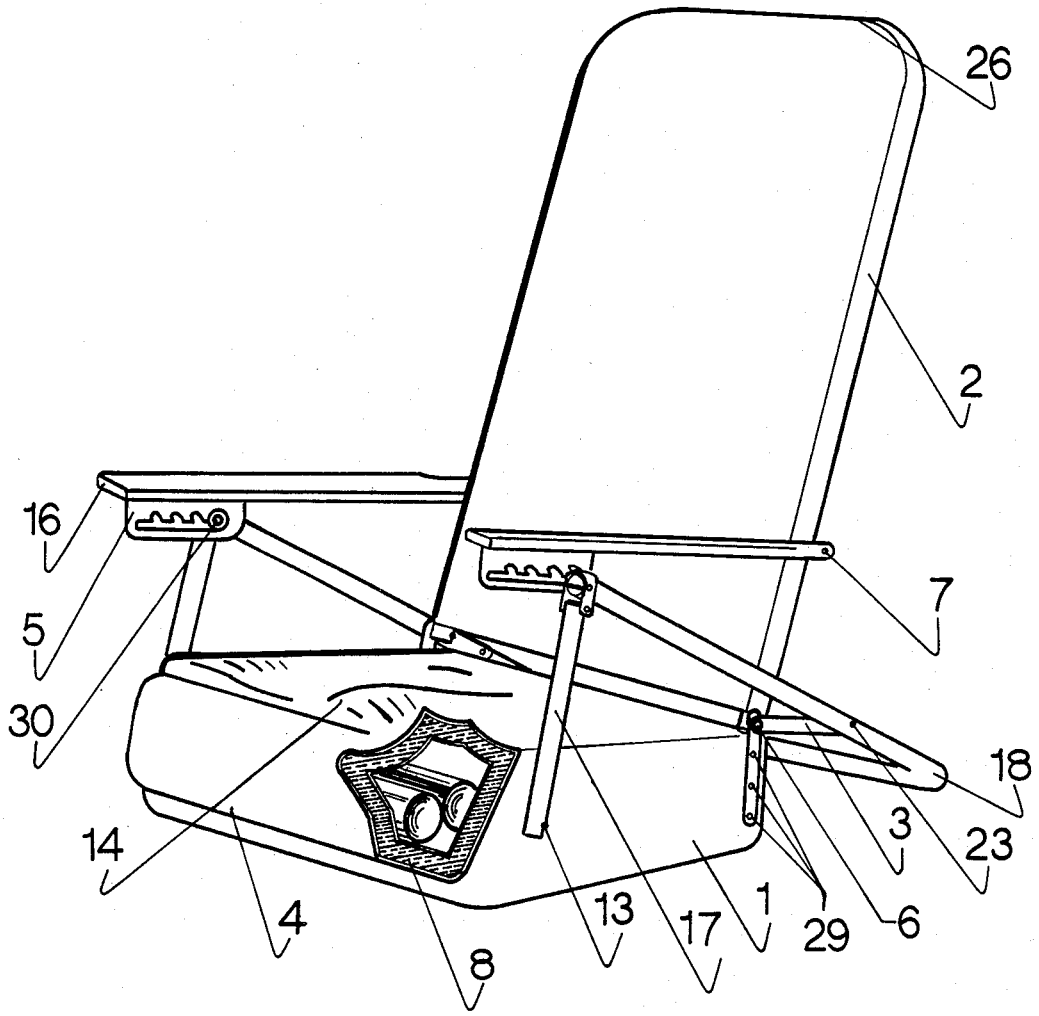
FIG. 1 is a perspective view of my invention in use with a cut away front view.
Figure 4:
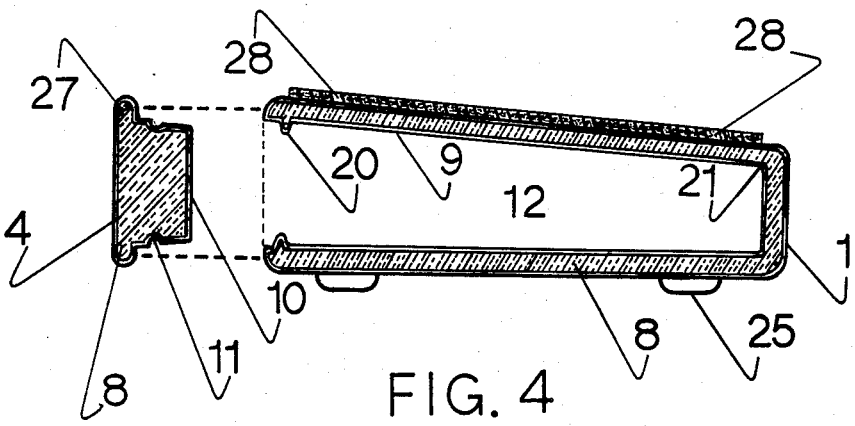
FIG. 4 is a cross sectional side view of the seat and lid portion of my invention.

Turning now to the drawings, with particular emphasis to FIGS. 4 and 1, it will be seen that the chair of this invention includes a hollow box like housing having an upper generally rectangular wall defining a seat platform 1 of injection moulded plastic, nylon, or other suitable material, which is defined by front, back, and side walls and an open front compartment, and lower generally rectangular wall.

An insulated closure panel of similar materials can be securely engaged to the seat platform to seal and insulate the seat compartment. The insulated closure panel or lid 4 may be engaged with liner 9 of plastic or similar materials at liner protrusion 20 and a lid recess contour 11. The lid 4 is preferably contour molded 27, so as to be easily grasped when engaging and disengaging. The inner portion of the lid 4 is preferably provided with insulating material 8 of polyurethane foam or similar insulating material and is protected with a lining material 10 of plastic, thermoplastic, or other suitable material.

Figure 3:
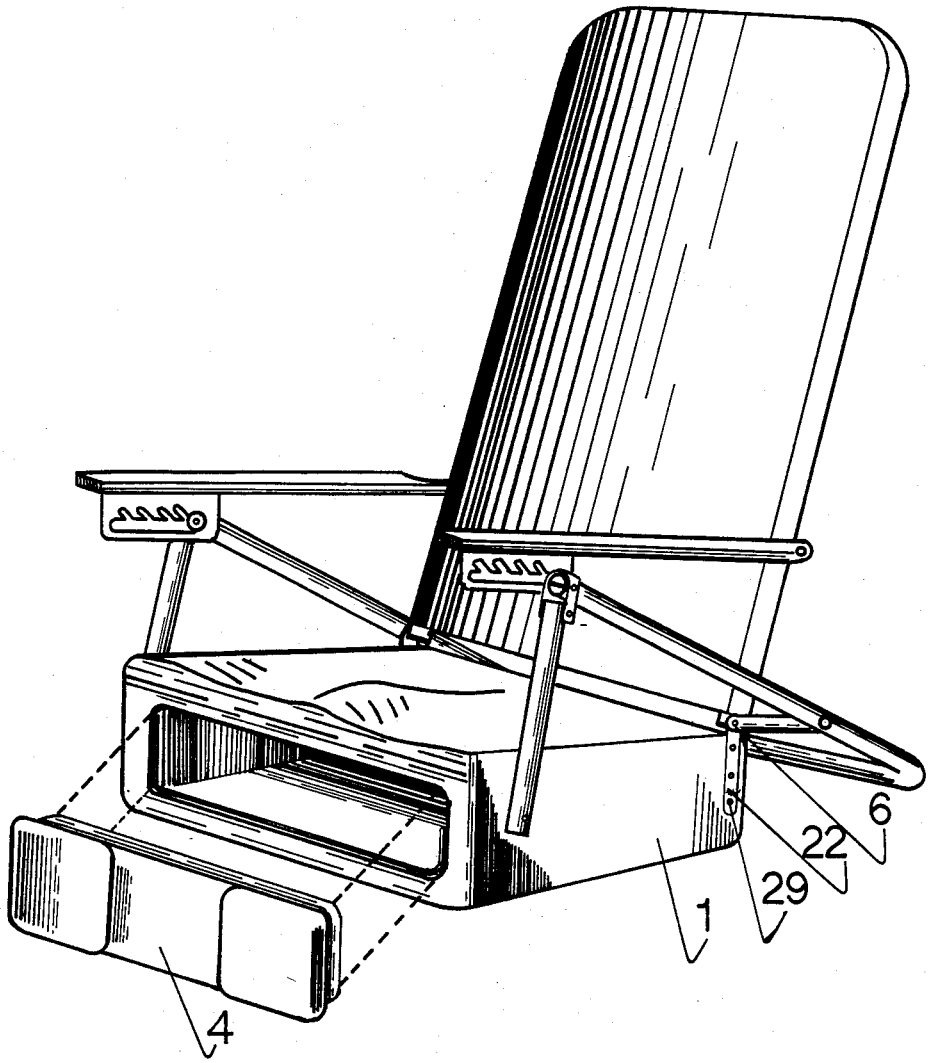
FIG. 3 is a perspective view of my invention in use with an exploded view of the lid.

The top portion of the seat platform 14 may be anatomically moulded as shown in FIG. 3 to the contour of the buttocks to provide added comfort to the occupant of the chair, this top portion 14 is preferable covered with a cushioning material of soft polyethylene foam or other suitable material 28 as shown in FIG. 4. Thermal insulating material 8 of polyurethane foam or similar insulating material, is preferably placed on the inside bottom, rear, and sides of the hollow seat compartment 12 and directly beneath and inside the top portion of the seat 14. A protective and stiffening liner 9 of plastic, thermoplastic, or similar materials, is preferably placed adjacent to the insulation 8 areas to protect the items contained in storage and to define the hollow inner compartment. This liner 9 is ideally provided with contour 21 to prevent debris from collecting and to allow easy cleaning. The entire hollow seat portion may be inexpensively moulded in one piece and foamed in place so as to be lightweight, inexpensively made, and easily reinforced to prevent collapse when occupied.

Figure 2:
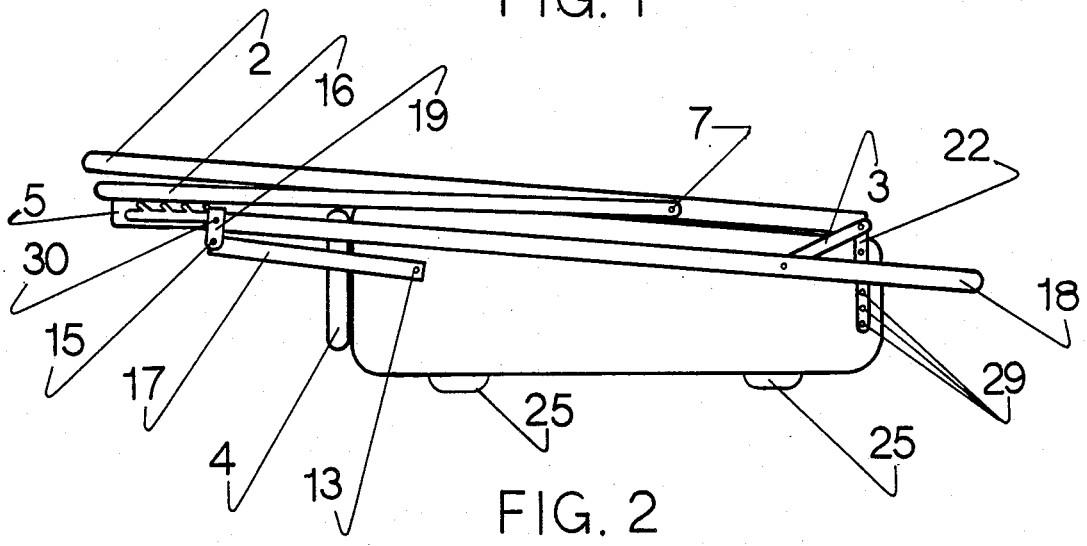
FIG. 2 is a detailed side view showing my invention as folded.

A hardware plate or link connection 22 of metal or other suitable material is securely fastened to seat portion 1 at 29 by rivets, screws, or the like as shown in FIG. 2. A support strut or link connection 3 of wood, metal, plastic, or the like is pivotally secured at 6 by means of similar materials to hardware link plate 22 and to stabilizer prop 18. Said stabilizer prop 18 may be constructed of tubular aluminum, plastic, or other suitable material and is pivotally secured by similar means to U-shaped link plate 19 at 30. Said U-shaped plate 19 is constructed of metal or similar material and secures front link strut 17 at 15. Front link strut 17 is pivotally secured to seat platform side wall at 13. Slotted detent rack 5 may be constructed of metal, plastic, or other suitable material and may be integrated with armrests 16 of similar materials and said armrests 16 are pivotally secured at 7 by rivets, screws, or other similar materials. All struts, props, armrests, and linking members, except hardware linking plate 22, are pivotally secured to allow easy reclining and folding of the device. Slotted detent rack 5 is secured by similar means to support prop 18 and to U-shaped plate 19 at 30.

Support link prop 18 is pivotally secured to support strut 3 at 23. Back rest 2 is pivotally secured by similar materials to hardware link plate 22 at 6 and is preferably bowed or contoured as seen at 26 to provide greater comfort to the occupant of the chair. Back rest 2 is of substantial length to support the upper body when in the reclining position. The entire support assembly of linking members having the purpose of allowing support to the occupant in a variety of reclining positions, allowing for easy compact folding and carrying, and durability. The bottom of the generally horizontal support surface is preferably provided with slight protrusions or bosses 25 which are integrated into the seat bottom and function to elevate the device from the earth or sand.

Figure 5:
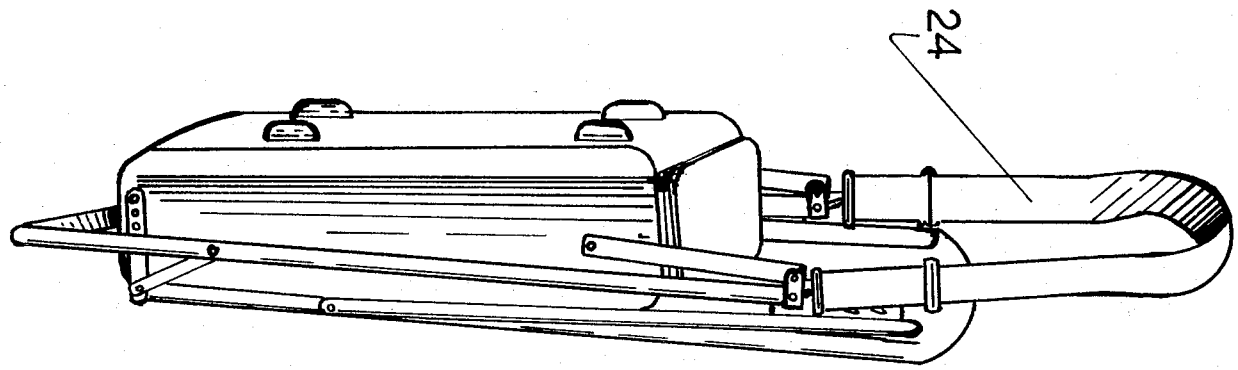
FIG. 5 is a perspective view of my invention with shoulder strap in the carrying mode.

An adjustable shoulder strap 24 may be connected by similar means to linking member at 30. Said shoulder strap 25 as seen in FIG. 5 may be constructed of nylon, fabric, or similar material and may preferably be secured by clips for easy removal. The purpose of said shoulder strap being to provide a more comfortable means of carrying the device and to assure the weight of the contents are distributed to the rear of the compartment.

From the above description and drawings it will be apparent that I have disclosed a chair and container combination comprising a hollow box-like housing having an upper generally rectangular wall defining a seat platform and a lower generally rectangular wall defining a generally horizontal support surface, said upper and lower walls being joined by a common back edge and generally triangular side walls defining a seat structure and an open front compartment, said upper and lower said side walls being constructed of insulating material for thermally insulating said open front compartment, and an insulated closure panel or lid for covering said open front and for providing access to said compartment for a person in a seated position on said seat support platform and a back rest pivotally secured to said housing.

Having illustrated and described a preferred embodiment as well as variants of this invention, it will be obvious to those skilled in the art that further changes and modifications may become apparent. Such changes and modifications are not to affect this instant concept and are to be considered within the scope and essence of this invention.

Having thus described this invention what is claimed as new is:

1. The combination of a portable insulated container and folding chair, comprising:

a hollow box-like housing having an upper generally rectangular wall defining a seat support platform having a front edge and a back edge and a lower generally rectangular wall defining a generally horizontal support surface, said upper wall and said lower wall joined by side walls, and a back wall, and defining a seat structure and an open front compartment, said upper and lower and said back and side walls are constructed of insulating material for thermally insulating said open front compartment, and an insulated closure panel for covering said open front and for providing access to said compartment for a person in a seated position on said seat support platform, and a back rest pivotally secured at the back top of said housing for extending upward in a support position and foldable onto said seat platform, and a generally U-shaped stabilizer prop pivotally connected at each end thereof to one end of a respective first link which in turn is connected to an armrest, the other end of the respective first link connected to the front of said housing, and said U-shaped prop connected intermediate the ends of the legs thereof to a second link which is further connected to the back of said housing for engaging a support surface beyond the back edge of said housing for supporting said back rest in said support position.

2. The combination according to claim 1 including:

the arm rest connecting each of said first link to said back rest.

3. The combination according to claim 2 wherein:

each of said arm rests are adjustably connected to said first link for adjustably supporting said back rest at selected positions between upright and reclining positions.

4. The combination according to claim 3 wherein:

said arm rests are adjustably connected to said first link by means of a pin and a slotted detent rack having a plurality of detents therein for engagement by said pin.

5. The combination according to claim 4 wherein:

said first link is about twice the length of said second link so that said prop extends to a common plane with said lower wall for engaging a common support surface therewith.

6. The combination of claim 5 wherein:

said housing is of a unitary construction and said closure panel is of a snap-in construction.

7. The combination of claim 6 wherein:

an elongated carrying shoulder strap having ends connected respectively to the point of connection said stabilizer prop to said first link so that said housing is carried by said strap with the open front oriented upwardly.

8. The combination according to claim 7 including:

a plurality of elevating protrusions extending from said lower horizontal support surface.

9. The combination according to claim 8 wherein:

a contour is provided to the upper generally rectangular wall defining the top of the seat platform.

10. The combination according to claim 2 wherein:

said first link is about twice the length of said second link so that said prop extends to a common plane with said lower wall for engaging a common support surface therewith.

11. The combination of claim 1 wherein:

said housing is of a unitary construction and said closure panel is of a snap-in construction.

12. The combination according to claim 1 including:

an elongated carrying shoulder strap having ends connected respectively at the connection of said stabilizer prop to said first link so that said housing is carried by said strap with the open front oriented upwardly.

13. The combination according to claim 1 including:

a plurality of elevating protrusions extending from said lower horizontal support surface.

14. The combination according to claim 1 wherein:

a contoured is provided to the upper generally rectangular wall defining the top of the seat platform.

* * * * *